United States Patent [19]

Flemming et al.

[11] Patent Number: 4,821,430

[45] Date of Patent: Apr. 18, 1989

[54] HEEL COUNTER FOR ATHLETIC SHOE AND FOOTWEAR INCORPORATING SAME

[75] Inventors: Udo Flemming, Erlangen; Willi Bauer, Herzogenaurach, both of Fed. Rep. of Germany

[73] Assignee: PUMA AG Rudolf Dassler Sport, Herzogenaurach, Fed. Rep. of Germany

[21] Appl. No.: 90,581

[22] Filed: Aug. 28, 1987

[30] Foreign Application Priority Data

Aug. 28, 1986 [DE] Fed. Rep. of Germany ..... 3629264

[51] Int. Cl.[4] ..... A43B 23/08

[52] U.S. Cl. ..... 36/69; 36/68

[58] Field of Search ..... 36/68, 69, 92, 71, 81, 36/82, 114; 128/614, 615

[56] References Cited

U.S. PATENT DOCUMENTS

| | | | |
|---|---|---|---|
| 1,972,899 | 9/1934 | Odell | 36/71 |
| 2,403,442 | 7/1946 | Klaus | 36/68 |
| 2,438,280 | 3/1948 | Gailey | 36/68 |
| 2,661,549 | 12/1953 | Lindner et al. | 36/68 |
| 3,333,353 | 8/1967 | Garcia | 36/69 |
| 4,255,877 | 3/1987 | Bowerman | 36/129 |
| 4,287,675 | 9/1987 | Norton et al. | 36/129 |
| 4,288,929 | 9/1981 | Norton et al. | 36/69 |
| 4,622,764 | 11/1986 | Bollier | 36/69 |
| 4,625,435 | 12/1986 | Veda | 36/69 |
| 4,638,576 | 1/1987 | Parracho et al. | 36/69 |

FOREIGN PATENT DOCUMENTS

| | | | |
|---|---|---|---|
| 8105 | 7/1928 | Australia | 36/82 |
| 109484 | 4/1928 | Fed. Rep. of Germany | 36/68 |
| 2035700 | 1/1972 | Fed. Rep. of Germany | 36/68 |
| 3342422 | 8/1984 | Fed. Rep. of Germany | 36/69 |
| 8792 | of 1890 | United Kingdom | 36/68 |

*Primary Examiner*—Steven N. Meyers

*Attorney, Agent, or Firm*—Sixbey, Friedman, Leedom & Ferguson

[57] ABSTRACT

Footwear having a heel counter comprised of a stiff resilient material, especially an athletic shoe for medium and long distance running, is improved so that a better pressure distribution is assured on the outersole, and also on a possibly existing middle sole, in the area of the heel counter. This is achieved by the fact that the surface area which is enclosed by the sidewalls of the heel counter is provided with a pressure distribution membrane which is connected to a thicker reinforced lower arcuate edge of the sidewalls of the counter, and the pressure distribution membrane is suitably contoured to facilitate the improved distribution of heel pressure to the midsole and outer sole. Downward arching of the distribution membrane under heel pressure applied by the foot of a wearer causes an upper edge area of the sidewalls to be drawn inwardly to hold the heel with greater force.

16 Claims, 2 Drawing Sheets

FIG. 1
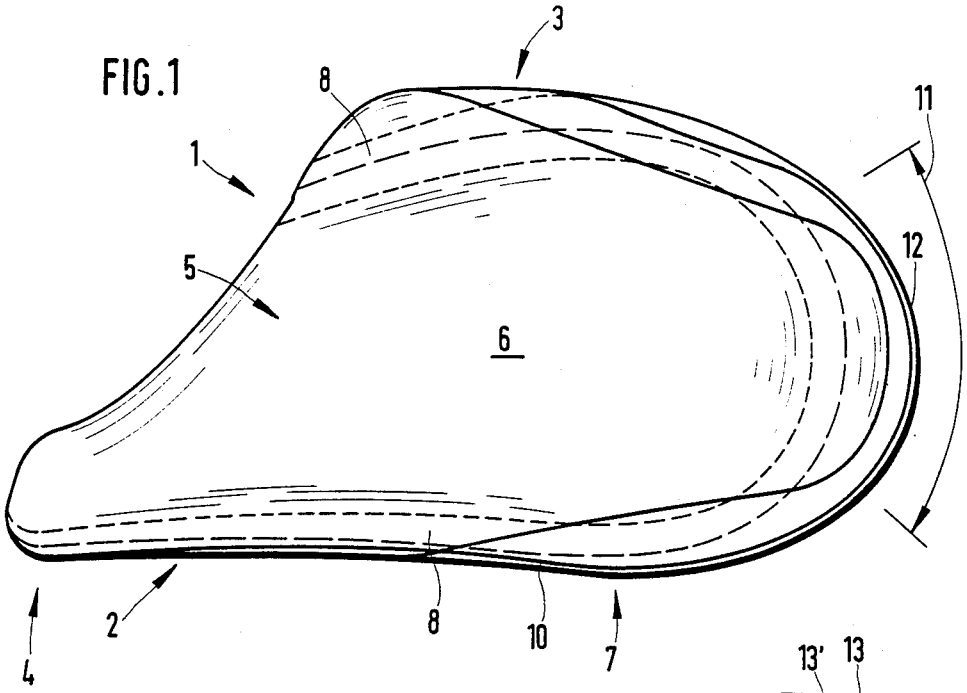
FIG. 2
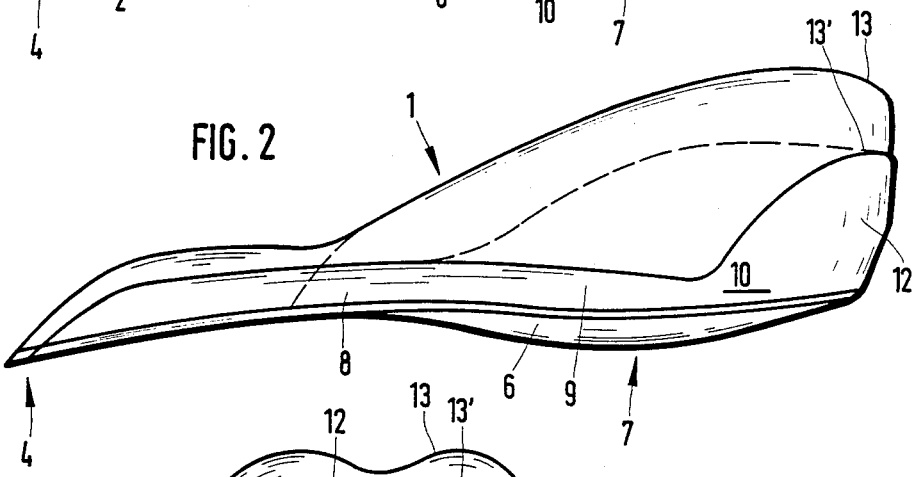
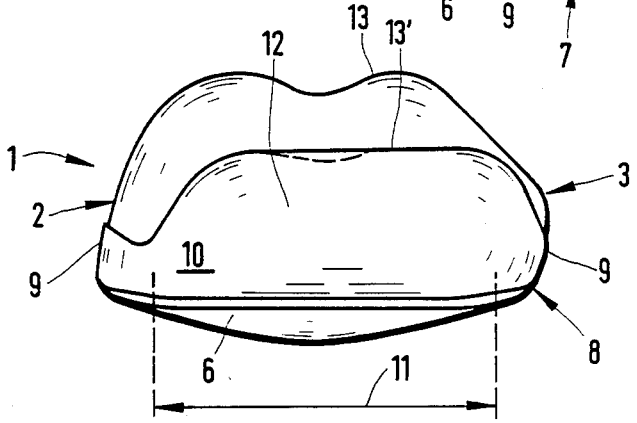
FIG. 3

HEEL COUNTER FOR ATHLETIC SHOE AND FOOTWEAR INCORPORATING SAME

BACKGROUND OF THE INVENTION

This invention relates to a heel counter of a stiff resilient material, for use with footwear such as athletic shoes, which are used, in particular, for medium and long distance running.

Heel counters made of leather, artificial leather or plastic have been used in the art, and such heel counters generally consist of a U-shaped curved wall which surrounds the heel of a shoe, and optionally includes an inwardly projecting edge, referred to as the lasting edge.

The problem with the prior art athletic shoes, and in particular those designed for medium and long distance running, is that the sole in the heel area of the shoe is deeply cushioned such that the heel of a person wearing the shoe, while walking, will sink relatively deep into the sole. Therefore, depending on the design of the lasting edge or the hardness of the heel counter material, injuries to the heel and/or damage to the shoe can occur.

Prior art shoe counters have also been made, as disclosedin U.S. Pat. No. 4,255,877 and U.S. Pat. No. 4,287,675 to Bowerman and Norton, et al., respectively, with a U-shaped curved wall which is formed with a flat base portion which interconnects the legs of the U-shaped wall. The base portion of these heel counters is included to provide lateral support for a basketball type shoe upper or to assist in controlling pronation of the foot when running. Neither of the devices of the above patents includes a contoured base portion to connect the legs of the U-shaped wall of the counter to provide for greater user comfort, and an improved distribution of the pressure as applied by the user's heel as a result of a curved surface, which effectively transmits the pressure to a greater surface area of the outer sole.

SUMMARY OF THE INVENTION

Therefore, the primary object of this invention is to design a heel counter of the type initially described so that the above-noted drawbacks are avoided. It is also an important object of the present invention to provide for a better pressure distribution on the outsole, and preferably on a cushioning midsole, in the area of the heel counter.

This object is achieved by the use of a curved pressure membrane at least partially covering the surface enclosed by the heel counter, wherein a pressure distribution occurs on a considerable surface of the outsole and a possible midsole in the rear sole area. As a result, a marked sinking of the heel into the sole during walking is avoided, especially the midsole, and the desired cushioning in the midsole is retained.

Another object is to eliminate any transition from the lasting edge to the sole, such that injury to the heel and/or premature wearing out of the shoe in this spot is also avoided.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 is a top plan view of a preferred embodiment of a heel counter according to the invention;

FIG. 2 is a side elevational view of the heel counter of FIG. 1;

FIG. 3 is a rear elevational view of the heel counter of FIG. 1; and

DESCRIPTION OF THE PREFERRED EMBODIMENT

Figure 4:
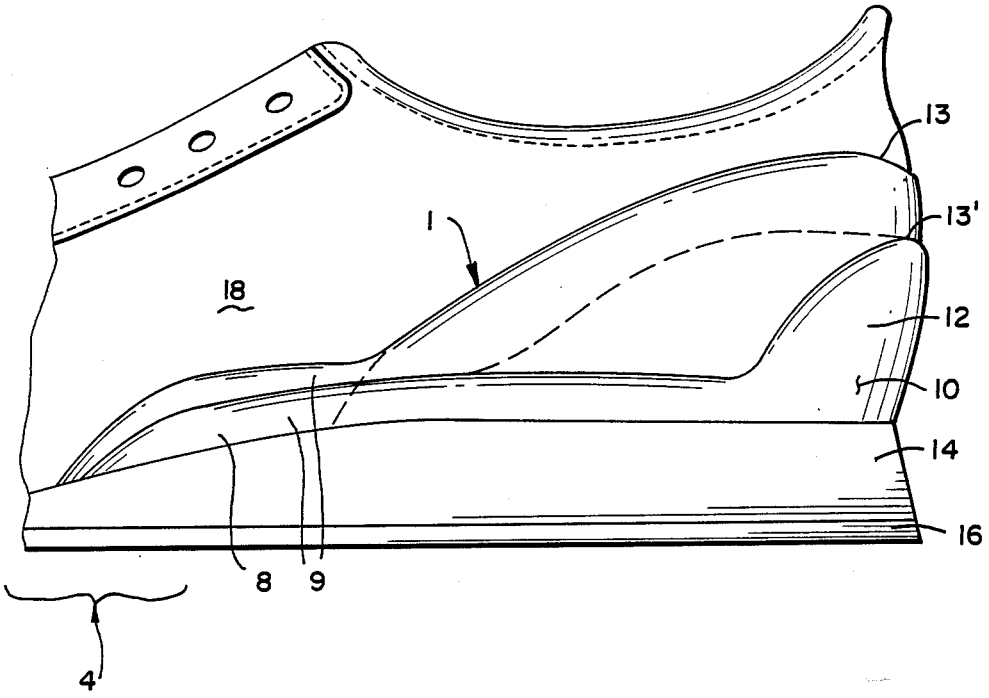
FIG. 4 is a partial side elevational view of a shoe utilizing the heel counter of FIGS. 1-3.

A heel counter is comprised of a relatively stiff resilient material and is identified by 1. Suitable materials for heel counter 1 advantageously are materials with a base of polyurethane, polyamide, polyimide, polyvinyl chloride, thermoplastics or natural or synthetic rubber. These materials can be used by themselves or as a mixture of two or more different components, and are shaped in an injection molding process. In the spirit of this invention, stiff resilient materials are those materials which have a Shore hardness of more than 50 Shore A.

Heel counter 1 includes a substantially U-shaped wall with sidewall portions 9 which extend on both the medial side 2 and the lateral side 3 of the foot to a point below the malleoli, and preferably, in addition, even somewhat beyond that to a point in front of said malleoli, so that the entire heel bone is completely enclosed by the heel counter 1.

Preferably, the heel counter 1 on the medial side 2 extends forward into an area 4 corresponding to the arch area of the foot. A pressure distribution membrane 6 extends over heel area 7 up to the surface area 5, which is defined by the forward extension of the sidewalls 9. The pressure distributor membrane 6 connects with the lower arcuate edge area 8 of the heel counter 1, and also is suitably contoured or arched downward so as to substantially match the heel of a person wearing the shoe. This arched portion provides for increased comfort to the wearer, as well as an improved transfer of heel pressure from the membrane 6 to the midsole and outer sole, which reduces the chance of injury to the heel or damage to the shoe. Pressure membrane 6 can be designed as a closed surface of a continuous film-like membrane, or the membrane may be provided with perforations or could also be made as a weight-saving lattice (not shown).

According to an advantageous further development of the invention, heel counter 1 is reinforced in the lower edge area 8 upward along sidewall portions 9 and rear heel area 11 as well as downward to pressure distribution membrane 6. The reinforcement thus has an angular cross section. The transition to the reinforcement preferably occurs gradually. The reinforcement area itself can be made by an increased thickness of heel counter 1 in said edge area 8 by way of a special support wall 10, which can be glued on or formed on the edge area 8. Preferably, the support wall 10 is injection molded on in this area.

Preferably, the reinforcement in rear heel area 11 is brought upward to form a dish-shaped stiffener 12, to give the heel, especially during walking, a good support and a good guiding. Stiffener 12 extends further forward on the outside 3 than on the inside 2. As a result, a greater side guiding is obtained for the heel when running around a curve.

Preferably, heel counter 1 and, optionally, also the reinforcement 12 on the rear upper edge, are recessed downward at 13 or 13' to avoid an irritation or possible injury to the Achilles' tendon by rubbing of the heel counter against the tendon when walking or running.

When a special support wall 10 is used as a reinforcement, it consists of a harder material than heel counter 1. The same materials proposed for heel counter 1, although preferably with greater degrees of hardness, are suitable as materials for support wall 10.

The wall thickness of heel counter 1 is approximately 1.0 to 2.0 mm, preferably 1.2 to 1.6 mm, the thickening, in other words the material thickness of heel counter 1 in this area or its wall thickness plus that of support wall 10, is approximately 2.2 to 3.5 mm, preferably 2.4 to 3.0 mm, and pressure distribution membrane 6 has a thickness of approximately 0.6 to 1.5 mm, preferably 0.8 to 1.2 mm.

The heel counter according to the invention can be used both as an internal heel counter and as an external heel counter applied over the backside of the shoe upper material. FIG. 4 shows the latter application in an otherwise conventional running shoe having a midsole 14, an outer sole 16, and an upper 18.

An additional advantage of the heel counter according to the invention resides in the fact that not only is an improved pressure distribution obtained in the heel area of the shoe, but also, because of the action of the membrane under pressure of a heel, the support action of this heel counter is considerably improved in relation to the usual heel counters, as a result of the change of form of the pressure distribution membrane in the sense of a greater downward arching (part 6, FIG. 2) that leads to an increased support action in the upper edge area (part 13, FIG. 2) of this heel counter. As a result, the upper flexible edge area of the heel counter is applied to the heel or wrapped around the heel with a greater frictional force, i.e., the upper edge area 13 of the sidewall portions 9 of the U-shaped wall are inherently caused to be drawn inwardly due to the deflection of the membrane 6 so as to result in the heel being held with greater force.

While we have shown and described a single embodiment in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. Footwear, particularly an athletic shoe designed for medium and long distance running, including a shoe upper, a heel counter of a relatively stiff resilient material that is disposed below and supporting the heel area of the shoe upper, a cushioning midsole, and an outer sole, the midsole and the outer sole being connected to the shoe upper, wherein said counter is disposed on the cushioning midsole and includes a generally U-shaped wall which is shaped to extend about a heel portion of the shoe upper, and which has two sidewall portions that extend forwardly from the heel area to a point at least under the medial and lateral malleoli of a wearer's foot, wherein a flexibly yielding pressure distribution membrane of 0.6 to 1.5 mm is connected to a substantially thicker reinforced lower arcuate edge area of said U-shaped wall and extends from one of the sidewall portions to the other of the sidewall portions as a means for distributing heel impact forces to the sidewall portions by arching downward to receive the heel bone of a wearer under heel pressure applied by the foot of a wearer during walking or running, thereby causing an upper edge area of the sidewall portions of the U-shaped wall to be drawn inwardly to hold the heel with greater force.

2. Footwear according ro claim 1, wherein said pressure distribution membrane extends over the entire area enclosed by said heel counter.

3. Footwear according to claim 2, wherein said pressure distribution membrane forms a closed surface.

4. Footwear according to claim 1, wherein the sidewall portion on the medial side of said heel counter extends forward to a middle area corresponding to an arch area of a user's foot.

5. Footwear according to claim 1, wherein said pressure distribution membrane forms a closed surface.

6. Footwear according to claim 1, wherein the reinforced area is formed by a support wall that is applied on the U-shaped wall at said lower arcuate edge area.

7. Footwear according to claim 6, wherein said support wall is formed of a harder material than said heel counter.

8. Footwear according to claim 6, wherein said support wall consists of material with a base selected from the group consisting of polyurethane, polyamide, polyimide, polyvinyl chloride, thermoplastic, natural and synthetic rubber.

9. Footwear according to claim 1, wherein the reinforced area of the sidewall portions extends downwardly into an area of the pressure distribution membrane, such that, in vertical cross section, the reinforced area approximately forms a right angle.

10. Footwear according to claim 1, wherein in a rear heel area the reinforced area is built up into a dish-shaped stiffener.

11. Footwear according to claim 10, wherein said stiffener on the lateral side of said heel counter extends further forward fhan on the medial side.

12. Footwear according to claim 10, wherein a rear upper edge of said heel counter and also said stiffener of the reinforced area are recessed downward to protect the Achilles' tendon.

13. Footwear according to claim 1, wherein a rear upper edge of said heel counter is recessed downward for protection of the Achilles' tendon.

14. Footwear according to claim 1, wherein said heel counter consists of material with a base selected from the group consisting of polyurethane, polyamide, polyimide, polyvinyl chloride, thermoplastic, natural and synthetic rubber.

15. Footwear according to claim 1, wherein the wall thickness in the area of the reinforced area is about 2.2 to 3.5 mm and in the remaining area of the U-shaped wall is about 1.0 to 2.0 mm.

16. Footwear according to claim 15, wherein a gradual transition in thickness is provided between adjacent areas of different wall thicknesses.

* * * * *